US011976643B2

(12) United States Patent
Xu et al.

(10) Patent No.: US 11,976,643 B2
(45) Date of Patent: May 7, 2024

(54) PISTON LIMITING STRUCTURE, COMPRESSOR, AND HEAT EXCHANGE APPARATUS

(71) Applicant: GREE ELECTRIC APPLIANCES, INC. OF ZHUHAI, Guangdong (CN)

(72) Inventors: Jia Xu, Guangdong (CN); Yusheng Hu, Guangdong (CN); Huijun Wei, Guangdong (CN); Sen Yang, Guangdong (CN); Zhongcheng Du, Guangdong (CN); Zhi Li, Guangdong (CN); Liping Ren, Guangdong (CN); Shebing Liang, Guangdong (CN); Rongting Zhang, Guangdong (CN); Zhengliang Shi, Guangdong (CN); Ning Ding, Guangdong (CN); Yibo Liu, Guangdong (CN); Shuang Guo, Guangdong (CN); Liping Liao, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 363 days.

(21) Appl. No.: 17/279,550

(22) PCT Filed: Sep. 20, 2019

(86) PCT No.: PCT/CN2019/106868
§ 371 (c)(1),
(2) Date: Mar. 24, 2021

(87) PCT Pub. No.: WO2020/125108
PCT Pub. Date: Jun. 25, 2020

(65) Prior Publication Data

US 2021/0340980 A1 Nov. 4, 2021

(30) Foreign Application Priority Data

Dec. 18, 2018 (CN) ..... 201811550007.5

(51) Int. Cl.
*F04B 37/00* (2006.01)

(52) U.S. Cl.
CPC ..... *F04B 29/00* (2013.01)

(58) Field of Classification Search
CPC ..... F04B 29/00; F01C 21/08; F01C 21/0836; F01C 21/0809; F04C 2240/20;
(Continued)

(56) References Cited

U.S. PATENT DOCUMENTS 2,275,240 A * 3/1942 Wiken ..... 417/462
3,056,356 A * 10/1962 Piper ..... F04B 1/1136 417/462

(Continued)

FOREIGN PATENT DOCUMENTS

CN 105604937 * 5/2016
CN 105604937 A 5/2016

(Continued)

OTHER PUBLICATIONS

CN105604937 English Translation, from Espacenet generated Sep. 12, 2023 (Year: 2023).*

(Continued)

*Primary Examiner* — Bryan M Lettman
(74) *Attorney, Agent, or Firm* — Dennemeyer & Associates LLC; Victoria Friedman

(57) ABSTRACT

A piston limiting structure, including: a cylinder, a piston, and a flange provided with a limiting piece, the cylinder has a piston hole perpendicular to an axial direction of the cylinder and penetrating through the cylinder, and a projection of the piston hole in a penetrating direction is circular. The piston is disposed in the piston hole in a form-fit manner and is slid in the piston hole in a reciprocating manner. A side wall of the piston is provided with a thrust groove, a bottom surface of the thrust groove forms a thrust surface on (Continued)

the side wall of the piston, and the thrust groove does not penetrate through two ends of the side wall of the piston along an axial length of the piston. The limiting piece abuts against the thrust surface.

20 Claims, 20 Drawing Sheets

(58) Field of Classification Search
CPC .... F04C 2240/30; F04C 18/344; F04C 29/00; F04C 2240/60
USPC ..... 417/462
See application file for complete search history.

(56) References Cited

U.S. PATENT DOCUMENTS 3,790,311 A 2/1974 Butts et al.
4,375,945 A * 3/1983 Jarrett ..... F02M 41/1405 417/462
4,445,825 A * 5/1984 Budecker ..... F04B 1/1071 417/462
4,601,274 A * 7/1986 Seilly ..... F02M 59/32 417/462
4,874,301 A * 10/1989 Greeves ..... F02M 41/1411 417/462
4,913,632 A * 4/1990 Thornthwaite .... F02M 41/1411 417/462
4,920,940 A * 5/1990 Harris ..... F02M 41/1411 417/462
5,179,889 A * 1/1993 Wusthof ..... F04B 1/0439 417/462
5,647,323 A * 7/1997 Kubo ..... F02M 41/1416 417/462

FOREIGN PATENT DOCUMENTS

CN 106065854 * 11/2017
CN 108799103 A 11/2018
CN 108799109 A 11/2018
CN 109555692 A 4/2019

OTHER PUBLICATIONS

International Search Report issued in connection with PCT Application No. PCT/CN2019/106868 dated Dec. 25, 2019.

* cited by examiner

PISTON LIMITING STRUCTURE, COMPRESSOR, AND HEAT EXCHANGE APPARATUS

CROSS-REFERENCE TO RELATED APPLICATION

The present disclosure is a national stage application of International Patent Application No. PCT/CN2019/106868, which is filed on Sep. 20, 2019 and claims priority to Chinese Patent Application No. 201811550007.5, filed on Dec. 18, 2018 and entitled "Piston limiting structure, compressor and heat exchange apparatus", the disclosure of which is hereby incorporated by reference in its entirety.

TECHNICAL FIELD

The disclosure relates to the field of compressors, and in particular to a piston limiting structure, a compressor, and a heat exchange apparatus.

BACKGROUND

A rotary cylinder piston compressor is a compressor based on a crosshead shoe principle, a cylinder thereof is rotated in a cylinder sleeve, a piston is arranged transversely in a piston hole of the cylinder, and reciprocated to be slid in the piston hole, thereby a compression chamber is formed among an end face of the piston, a side wall of the piston hole and an inner wall of the cylinder sleeve.

In order to guarantee fit degree and applicability between the piston and the piston hole, from a manufacturing perspective, applying a circular piston hole and a piston with a cylindrical cross section is apparently the best, and it is the easiest to guarantee the machining accuracy. However, in this case, because the piston hole is arranged transversely in the cylindrical piston, two end edges of the piston hole are actually intersecting lines of two cylinders, a length along a circumferential direction everywhere is varied continuously. Similarly, two end edges of the piston are also intersecting lines of the two cylinders (i.e. consistent with the two end edges of the piston hole), and a length of the piston along a circumferential direction thereof everywhere is also varied continuously. In an ideal state, a bus of a piston head (namely an end face) should be parallel to a bus of an outer surface of the cylinder, so that a destination of a reciprocating motion of the piston perfectly fits the inner wall of the cylinder sleeve (namely the end face of the piston and the outer surface of the cylinder form a completed cylindrical surface) to complete the exhaust. However, in fact, while the piston with the circular cross section is applied, the piston is auto-rotated relative to the cylinder during an operation process, because the lengths of the piston and the piston hole along the circumferential direction everywhere are both varied continuously, once the relative rotation is generated between two parties, the completed cylindrical surface may not be formed by the end face of the piston and the outer surface of the cylinder, the interference between the head of the piston and the inner wall of the cylinder sleeve is caused in a compression process of the piston, so that the collision to the cylinder is generated.

In order to solve a problem that the collision to the cylinder is generated by the circular piston, the rotary cylinder piston compressor is improved by using two solutions in the art known to inventors.

I. A non-circular piston is used, and the piston hole of the cylinder also needs to be correspondingly set as a non-circular shape, a non-circular structure is poor in machining manufacturability, harmful to large-scale production, and difficult to machine and guarantee the accuracy. In addition, there are multiple matching sizes for a matching surface of the piston and the cylinder, for example, outer diameters of two non-circular sections, a center distance of a semi-circular arc surface, a length of a parallel segment, and a width of the piston, it is difficult to simultaneously guarantee a matching clearance between the piston and the cylinder in an assembly process, the assembly and performance of the compressor are affected. In addition, the parallel segment of the non-circular piston has a larger deformation during actual operation, a reliability of the compressor is affected.

II. A limiting structure is additionally axially arranged on the circular piston, and thereby the auto-rotation of the piston is limited. Specifically, an axial surface of the circular piston is provided with a pin, and a corresponding position of the piston hole of the cylinder is provided with a through pin avoidance groove, the piston is limited by the pin and the avoidance groove, so that the piston is prevented from being rotated. However, in such a solution, although the piston is the circular piston, the corresponding piston hole is actually non-circular due to the arrangement of the through avoidance groove, and the avoidance groove is cooperated with the pin, so that an end portion of the avoidance groove is located at an air suction-exhaust chamber, an air suction-exhaust process of a pump body is affected, and a natural clearance volume is introduced at a terminal end of compression. In addition, the cooperation of the pin and the avoidance groove is located between two compression chambers, and it needs to be guaranteed that two chamber bodies are sealed, thereby it belongs to a finish machining position, a machining process, such as linear cutting, specially harmful to the large-scale production is still necessary to be used for the cylinder. Therefore, how to solve the cylinder collision problem of the circular piston becomes a research direction for improving the rotary cylinder piston compressor.

SUMMARY

In order to solve technical problems in an art known to inventors that a circular piston is auto-rotated to cause interference between a piston head and an inner wall of a cylinder sleeve or even collision to a cylinder, and a limiting structure between the circular piston and the cylinder introduces a natural clearance volume, some embodiments of the disclosure provide a piston limiting structure with high cooperation accuracy capable of preventing piston auto-rotation without introducing a clearance volume.

At the same time, in order to solve technical problems that a limiting structure of a circular piston in a rotary cylinder piston compressor known to inventors may introduce a clearance volume and is high in machining process requirements, some embodiments of the disclosure provide a compressor using a circular piston without introducing a clearance volume.

Furthermore, in order to solve technical problems similar to the above technical problems, some embodiments of the disclosure further provide a heat exchange apparatus.

In a first aspect, some embodiments of the disclosure provide a piston limiting structure, including: a cylinder, having a piston hole perpendicular to an axial direction of the cylinder and penetrating through the cylinder, wherein a projection of the piston hole in a penetrating direction is circular; a piston, disposed in the piston hole in a form-fit manner and slid in the piston hole in a reciprocating manner, wherein a side wall of the piston is provided with a thrust groove, a bottom surface of the thrust groove forms a thrust surface on the side wall of the piston, and the thrust groove does not penetrate through two ends of the side wall of the piston along an axial length of the piston; and a flange, provided with a limiting piece, wherein the limiting piece abuts against the thrust surface to limit the piston to be rotated around an axis of the piston itself.

In some embodiments, the thrust surface is perpendicular to the axial direction of the cylinder.

In some embodiments, the flange has a lug boss, an end face of the cylinder is provided with an assembling hole penetrating to the piston hole, the lug boss and the assembling hole are insertion-connected in the form-fit manner so that the end face of the cylinder abuts against an end face of the flange, and the cylinder is rotation-connected with the flange, the limiting piece is disposed on the lug boss, an end face at one side of the limiting piece abuts against the thrust surface to limit the piston to be rotated around the axis of the piston itself.

In some embodiments, while the lug boss is cooperated with the assembling hole, it is satisfied:

$$h_2 \geq h_3$$

Herein, $h_2$ is a distance of the piston hole from an endpoint along the axial direction of the cylinder to an end face at one side, close to the endpoint, of the cylinder, and $h_3$ is a height of the lug boss along the axial direction of the cylinder.

In some embodiments, the flange is provided with a sink groove, the end face of the cylinder is provided with a short shaft protruded outwardly, the short shaft is insertion-connected with the sink groove in the form-fit manner so that the end face of the cylinder abuts against the end face of the flange, and the cylinder is rotation-connected with the flange, an end face of the short shaft is provided with an assembling hole penetrating to the piston hole, the limiting piece is disposed in the assembling hole, an end face at one side of the limiting piece abuts against the thrust surface to limit the piston to be rotated around the axis of the piston itself.

In some embodiments, while the end face at one side of the limiting piece abuts against the thrust surface, it is satisfied:

$$h_1+h_2 \geq h_5$$

Herein, the $h_1$ is a groove depth of the thrust groove, the $h_2$ is the distance of the piston hole from the endpoint along the axial direction of the cylinder to the end face at one side, close to the endpoint, of the cylinder, and the $h_5$ is a height from the end face at one side of the limiting piece to an end face of the flange.

In some embodiments, while the end face at one side of the limiting piece abuts against the thrust surface, it is satisfied:

$$h_1+h_2 \leq h_5$$

Herein, the $h_1$ is a groove depth of the thrust groove, the $h_2$ is the distance of the piston hole from the endpoint along the axial direction of the cylinder to the end face at one side, close to the endpoint, of the cylinder, and the $h_5$ is a height from the end face at one side of the limiting piece to the end face of the flange.

In some embodiments, the thrust groove is disposed in a position of ½ of the axial direction of the piston.

In some embodiments, while the piston is reciprocated to be slid in the piston hole, it is satisfied:

$$L_1-L_2 \geq S$$

Herein, the $L_1$ is a length of the thrust groove along an axial direction of the piston, the $L_2$ is a length of the limiting piece along the axial direction of the piston, and the S is a stroke of the piston slid in the cylinder.

In some embodiments, the limiting piece includes a circular ring structure.

In some embodiments, the limiting piece is integrally formed with the flange.

In some embodiments, a diameter of the limiting piece is less than a diameter of the assembling hole, so that an avoidance space is formed on the flange.

In some embodiments, the limiting piece includes a limiting ring, an end face at one end of the limiting ring abuts against the flange, and an end face at the other end abuts against the thrust surface.

In some embodiments, a diameter of the limiting ring is equal to the diameter of the assembling hole, a part of an outer side wall of the limiting ring circumferentially abuts against a side wall of an assembling hole of the cylinder, so that the limiting ring is limited to be radially moved.

In some embodiments, the limiting ring is made of a wear-resistant material.

In some embodiments, the flange includes at least one of an upper flange and a lower flange.

In a second aspect, some embodiments of the disclosure provide a compressor, including:

a rotation shaft;

an upper flange;

a lower flange;

a cylinder sleeve, disposed between the upper flange and the lower flange; and the above piston limiting structure, herein the cylinder is disposed in the cylinder sleeve, the rotation shaft successively passes through the upper flange, the cylinder sleeve, and the lower flange, the cylinder is driven to be rotated by the rotation shaft.

In a third aspect, some embodiments of the disclosure provide a heat exchange apparatus, including the above piston limiting structure.

In some embodiments, the heat exchange apparatus is an air conditioner.

A technical scheme of some embodiments of the disclosure has at least one of the following beneficial effects.

In the piston limiting structure provided by some embodiments of the disclosure, the cylinder, the piston and the flange are included, the cylinder has the piston hole perpendicular to the axial direction of the cylinder and penetrating the cylinder, the projection of the piston hole in the penetrating direction is circular, the piston is arranged in the piston hole in the form-fit manner and may be reciprocated to be slid in the piston hole, the circular piston and the circular piston hole are used, the manufacturability of the piston and the cylinder is good, the machining is convenient, the machining accuracy is guaranteed, the large-scale production is easy, and a distance from the piston hole of the cylinder to the end face of the cylinder is a uniform transition which is similar to an arch bridge structure, the structure is firmer and not easy to be deformed, at the same time, the circular piston is cooperated with the circular piston hole of the cylinder, it is beneficial to control an assembly clearance between the piston and the cylinder, and beneficial to reduce friction power and leakage, thereby the performance of the piston compressor is improved.

The side wall of the piston is provided with the thrust groove, the bottom surface of the thrust groove forms the thrust surface on the side wall of the piston, the thrust groove does not penetrate two ends of the side wall of the piston along an axial length of the piston, an avoidance groove does not exist between the piston and the inner wall of the cylinder, the thrust groove is not communicated with a volume chamber, and a clearance volume may not be introduced, so that the rotary cylinder compressor is worked more stably.

The flange is provided with the limiting piece, the limiting piece abuts against the thrust surface to limit the piston to be rotated around the axial direction of the piston itself, the piston is limited by the limiting piece, so that the piston does not be auto-rotated, thereby the problem of collision to the cylinder is effectively solved, and the stability and reliability of the compressor are improved.

In the piston limiting structure provided by some embodiments of the disclosure, the thrust surface is perpendicular to the axial direction of the cylinder, the machining for the thrust groove is convenient, the machining accuracy is guaranteed, and the production and formation are easy.

In the piston limiting structure provided by some embodiments of the disclosure, the flange has the lug boss, the end face of the cylinder is provided with the assembling hole penetrating to the piston hole, the lug boss and the assembling hole are cooperated so that the cylinder is rotatably connected with the flange, the limiting piece is disposed on the lug boss, the end face at one side, away from the lug boss, of the limiting piece abuts against the thrust surface to limit the piston to be rotated around the axial direction of the piston itself. The flange is provided with the lug boss, the lug boss is rotation-connected with the cylinder in an inner circle fit manner, the operation of the cylinder is not affected by the limiting structure, at the same time, the limiting piece is cooperated with the thrust surface in the piston in an abutting manner, the clearance volume may not be introduced, so that the compressor is worked more stably.

In the piston limiting structure provided by some embodiments of the disclosure, the flange is provided with the sink groove, the end face of the cylinder is provided with the short shaft protruded outwardly, the short shaft is insertion-connected with the sink groove in the form-fit manner so that the end face of the cylinder abuts against the end face of the flange, and the cylinder and the flange are rotation-connected, the end face of the short shaft is provided with the assembling hole penetrating to the piston hole, the limiting piece is disposed in the assembling hole, and the end face at one side of the limiting piece abuts against the thrust surface to limit the piston to be rotated around the axial direction of the piston itself. The cylinder is rotation-connected with the flange in an outer circle fit manner, the operation of the cylinder is not affected by the limiting structure, at the same time, the limiting piece is cooperated with the thrust surface in the piston in the abutting manner, and the clearance volume may not be introduced, so that the compressor is worked more stably.

In the piston limiting structure provided by some embodiments of the disclosure, while the end face at one side of the limiting piece abuts against the thrust surface, it is satisfied: $h_1+h_2 \geq h_5$, herein, the $h_1$ is the groove depth of the thrust groove, the $h_2$ is the distance of the piston hole from the endpoint along the axial direction of the cylinder to the end face of the cylinder, and the $h_5$ is the height from the end face at one side of the limiting piece to the end face of the flange. While the formula is satisfied, after the compressor is mounted, a minute clearance exists between the thrust surface of the piston and the end face of the limiting piece, thereby requirements of machining and assembling accuracy for the piston, the limiting piece and the cylinder are lower, the machining and production are easy, and a cost is reduced.

In the piston limiting structure provided by some embodiments of the disclosure, while the end face at one side, away from the lug boss, of the limiting piece abuts against the thrust surface, it is satisfied: $h_1+h_2 \leq h_5$, herein, the $h_1$ is the groove depth of the thrust groove, the $h_2$ is the distance of the piston hole from the endpoint along the axial direction of the cylinder to the end face of the cylinder, and the $h_5$ is the height from the end face at one side of the limiting piece to the end face of the flange. While the formula is satisfied, after the compressor is mounted, the piston is jacked up by the flange and the limiting piece for a minute distance, a weight of the piston itself is loaded by the limiting piece, the auto-rotation of the piston is limited by gravity, the limiting effect is better, and clearances between the piston and the cylinder and between the end face of the cylinder and assembling pieces are controlled by adjusting a jacking height, so that the assembly accuracy is higher, at the same time the friction power consumption is reduced, and the performance of a whole machine is better.

In the piston limiting structure provided by some embodiments of the disclosure, the thrust groove is disposed in the position of ½ of the axial direction of the piston, while the piston is reciprocated to be slid in the piston hole, it is satisfied: $L_1-L_2 \geq S$, herein, the $L_1$ is the length of the thrust groove along the axial direction of the piston, the $L_2$ is the length of the limiting piece along the axial direction of the piston, and the S is the stroke of the piston slid in the cylinder. The length of the thrust groove is greater than a sum of limiting piece and piston stroke lengths, thereby it is guaranteed that the piston does not collide with the limiting piece while being reciprocated to be slid, the stability and the reliability are guaranteed.

In the piston limiting structure provided by some embodiments of the disclosure, the limiting piece is the circular ring structure, the machining and assembling are convenient, and the machining accuracy is guaranteed.

In the piston limiting structure provided by some embodiments of the disclosure, the limiting piece is integrally formed with the flange, assembling structures are reduced, and the machining and forming are convenient. The diameter of the limiting piece is less than the diameter of the assembling hole, so that the avoidance space is formed on the flange, the diameter of the limiting piece is reduced, so that a minimum length requirement of the thrust groove is reduced, and a sealing distance between the piston and the inner wall of the cylinder is enlarged, under a precondition of satisfying a minimum sealing distance requirement, the piston and cylinder diameters are correspondingly designed to be reduced, and the mechanical power consumption of the compressor is reduced.

In the piston limiting structure provided by some embodiments of the disclosure, the limiting piece includes the limiting ring, the end face at one end of the limiting ring abuts against the flange, and the end face at the other end abuts against the thrust surface. The limiting piece and the flange are set as a split-type structure, a machining difficulty of the limiting ring is reduced, and the machining and assembling of the limiting ring are convenient.

In the piston limiting structure provided by some embodiments of the disclosure, the diameter of the limiting ring is equal to the diameter of the assembling hole, a part of the outer side wall of the limiting ring circumferentially abuts against the side wall of the assembling hole of the cylinder, so that the limiting ring is limited to be radially moved. The cylinder is used to radially limit the limiting ring, so that the limiting ring does not radially collide with the cylinder during a rotation process of the cylinder and the piston, and the compressor is worked more stably and reliably. The limiting ring is made of the wear-resistant material, friction loss between the limiting piece and the piston is effectively reduced, and only the limiting ring adopts the wear-resistant material, the cost is effectively reduced.

In the compressor provided by some embodiments of the disclosure, the rotation shaft, the upper flange, the lower flange, the cylinder sleeve and the piston limiting structure are included, the cylinder is disposed in the cylinder sleeve, the rotation shaft successively passes through the upper flange, the cylinder sleeve, and the lower flange, the cylinder is driven to be rotated by the rotation shaft. Because the compressor has the above piston limiting structure, it has all of the above beneficial effects.

In the heat exchange apparatus provided by some embodiments of the disclosure, the above piston limiting structure is included, therefore the heat exchange apparatus has all of the above beneficial effects.

BRIEF DESCRIPTION OF THE DRAWINGS

In order to more clearly describe specific implementation modes of the disclosure or technical schemes in an art known to inventors, drawings to be used in descriptions of the specific implementation modes or an art known to inventors are briefly introduced below. Apparently, the drawings in the following descriptions are some of the implementation modes of the disclosure, and other drawings may also be obtained by those of ordinary skill in the art without creative work according to these drawings.

DETAILED DESCRIPTION OF THE EMBODIMENTS

Figure 1:
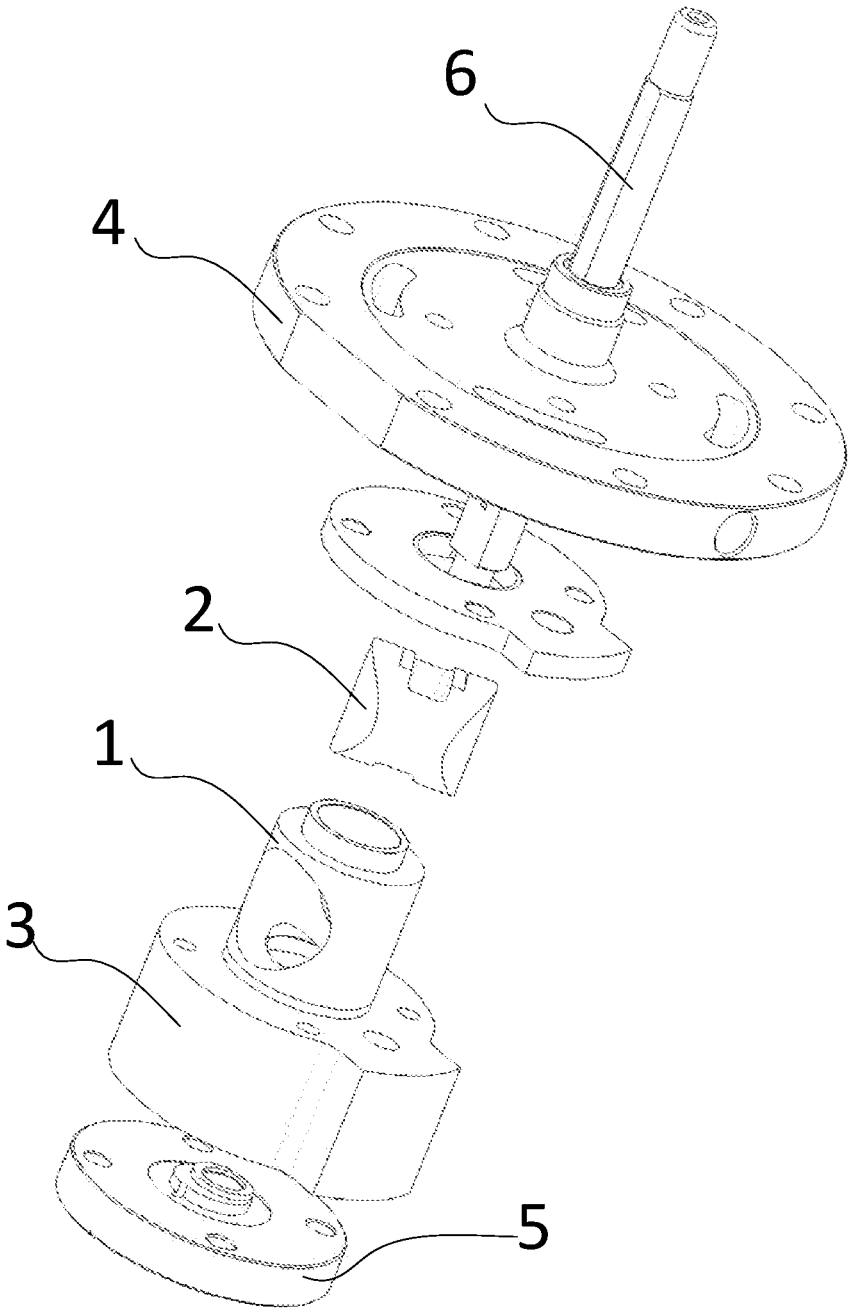
FIG. 1 is an exploded schematic diagram of a compressor in some embodiments of the disclosure.

Technical schemes of the disclosure are clearly and completely described below in combination with drawings. Apparently, described embodiments are a part of the embodiments of the disclosure, not all of the embodiments. Based on the embodiments in the disclosure, all other embodiments obtained by those of ordinary skill in the art without creative work shall fall within a scope of protection of the disclosure. In addition, technical features involved in the different embodiments of the disclosure described below may be combined with each other as long as there is no conflict between them.

A rotary cylinder piston compressor in an art known to inventors includes a flange, a cylinder sleeve, a cylinder, a piston and a rotation shaft, based on a crosshead shoe principle, the piston is reciprocated to be slid relative to the cylinder during a rotation process, thereby two ends of the piston form a compression chamber and an exhaust chamber with the cylinder and the cylinder sleeve. For the piston of the rotary cylinder piston compressor, a degree of freedom of auto-rotation of the piston around an axis of the piston itself needs to be limited. The piston limiting structure provided by some embodiment of the disclosure may be used for the rotary cylinder piston compressor in an art known to inventors, thereby it is achieved that the piston is limited.

It is to be noted that a limiting relation between the flange and the cylinder may include an inner circle support and an outer circle support. The inner circle support means that an end face of the cylinder is provided with a circular assembly through hole, the flange is provided with a lug boss corresponding to it, the lug boss is insertion-connected in the assembly through hole, and a side wall of the lug boss abuts against an inner wall of the assembly through hole, because of form-fit of two parties, the cylinder is radially limited while the cylinder is rotated around the lug boss. The outer circle support means that the end face of the cylinder is provided with a circular protruded short shaft, the flange is provided with a corresponding sink groove, the short shaft is insertion-connected in the sink groove, and an outer wall of the short shaft abuts against a side wall of the sink groove, and because of form-fit of two parties, the cylinder is radially limited while the short shaft of the cylinder is rotated in the sink groove.

FIG. 1 to FIG. 5B show a first embodiment of a piston limiting structure of the disclosure, the cylinder and the lower flange in some embodiments are limited by using the inner circle support.

As shown in FIG. 1 to FIG. 5B, the piston limiting structure provided by some embodiments of the disclosure includes a cylinder 1, a piston 2 and a lower flange 5. In some embodiments, the cylinder 1 is a cylindrical cylinder, an axial direction of the cylinder 1 is provided with an assembling hole 12 penetrating the cylinder 1, and a rotation shaft 6 passes through the assembling hole 12. A peripheral surface of the cylinder 1 is provided with a piston hole 11 perpendicular to a direction of the assembling hole 12 and penetrating the cylinder 1, and a projection of the piston hole 11 along an axial direction of the piston hole itself is circular.

Figure 4A:
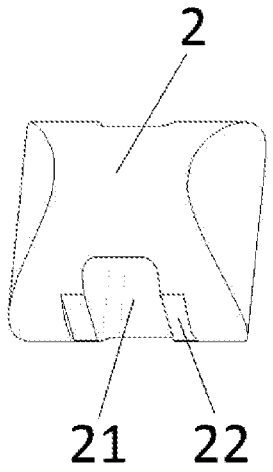
FIG. 4A, FIG. 4B and FIG. 4C are a piston structure schematic diagram in some embodiments of the disclosure.
Figure 4B:
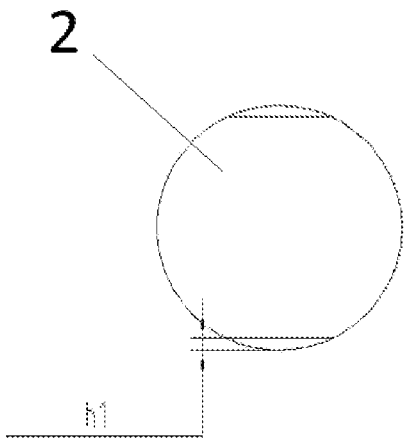
Figure 4C:
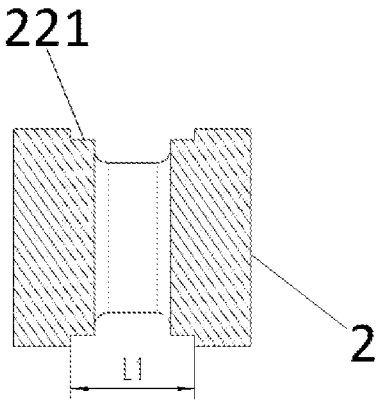

As shown in FIG. 4A, FIG. 4B and FIG. 4C, the piston 2 is disposed in the piston hole 11 in a form-fit manner and is reciprocated to be slid in the piston hole 11. The piston 2 is matched with the piston hole 11, the piston 2 is a structure similar to a cylinder, end faces at two ends of the piston 2 are curved surface structures which are cooperated with the piston hole 11 to form a completed cylindrical surface, an axial length of the piston 2 is less than a radial size of the cylinder 1, and the piston 2 is reciprocated to be slid in the cylinder 1. A middle portion of the piston 2 is provided with a shaft hole 21 along an axial direction of the cylinder 1, while the piston 2 is mounted in the piston hole 11, the rotation shaft 6 passes through the assembling hole 12 of the cylinder 1 and the shaft hole 21 on the piston 2. A side wall of the piston 2 is provided with a thrust groove 22, and the thrust groove 22 forms a thrust surface 221 on the side wall of the piston 2. As shown in FIG. 4A, FIG. 4B and FIG. 4C, in some embodiments, the thrust groove 22 is symmetrically arranged at two sides of the shaft hole 21 at a lower end of the piston 2 and the thrust surface 221 is perpendicular to an axis of the cylinder 1, the thrust groove 22 does not penetrate through two ends of the side wall of the piston 2 along an axial length of the piston 2.

The lower flange 5 is provided with a limiting piece 52, an end face of the limiting piece 52 abuts against the thrust surface 221 to limit the piston 2 to be rotated around the axis of the piston itself. In some embodiments, a cylindrical lug boss 51 is formed in the middle of an upper end face of the lower flange 5, the limiting piece 52 is integrally formed on the lug boss 51, a cross section of the limiting piece 52 is circular, a middle portion of the lower flange 5 is provided with an eccentric shaft hole, and the shaft hole successively penetrates through the limiting piece 52, the lug boss 51 and the lower flange 5.

Figure 2:
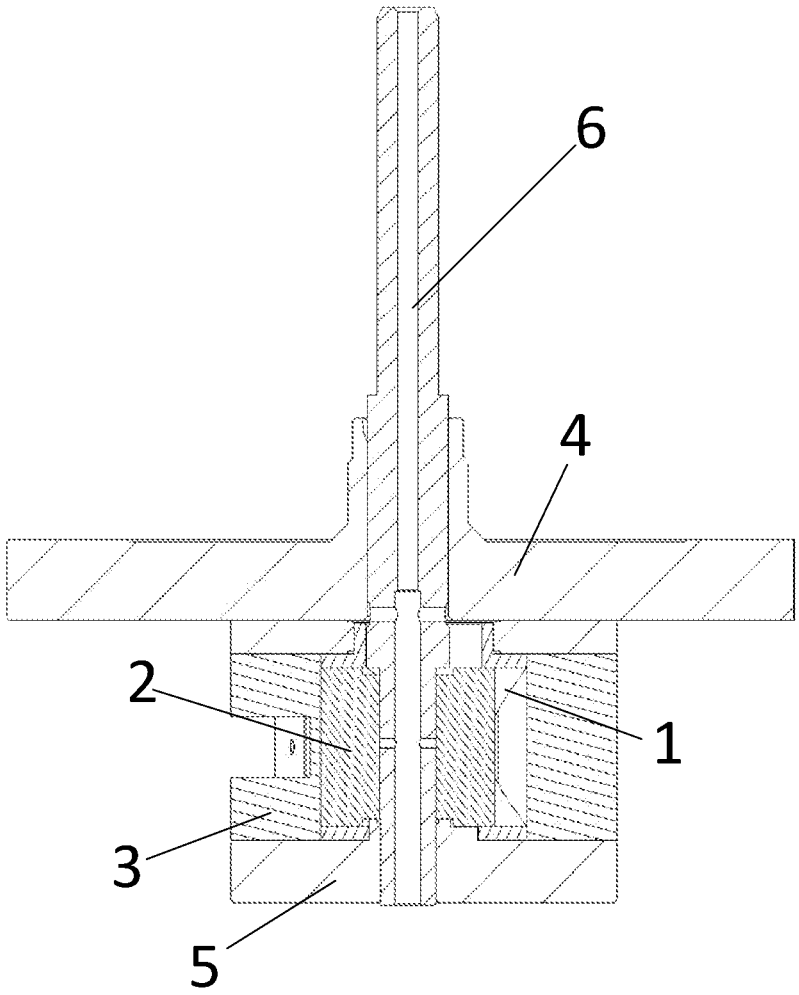
FIG. 2 is an assembly structure section view of the compressor in some embodiments of the disclosure.
Figure 3A:
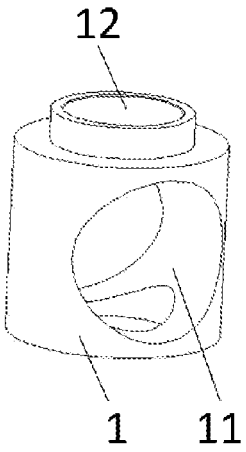
FIG. 3A, FIG. 3B and FIG. 3C are a cylinder structure schematic diagram in some embodiments of the disclosure.
Figure 3B:
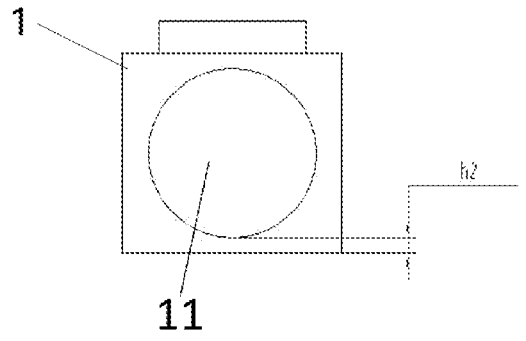
Figure 3C:
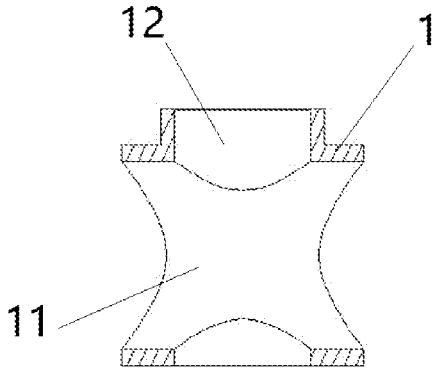

As shown in FIG. 2, while the piston 2 and the cylinder 1 are assembled with the lower flange 5, the lug boss 51 of the lower flange 5 is cooperated with the assembling hole 12 of the cylinder 1, so that the cylinder 1 is rotated around the axial direction of the cylinder itself, and while the piston 2 is rotated to be reciprocated relative to the limiting piece 52, an upper end face of the limiting piece 52 always abuts against the thrust surface 221 of the piston 2, so that the piston 2 may not be rotated around the axis of the piston itself.

In some embodiments, the piston 2 is rotated to be reciprocated relative to the limiting piece 52 in a working state, thereby it is guaranteed that the piston 2 does not collide with the limiting piece 52 in a process of a rotation reciprocating motion, while the piston 2 is reciprocated to be slid in the piston hole 11, it is satisfied:

$$L_1-L_2 \geq S$$

Herein, as shown in FIG. 3A to FIG. 5B, the L1 is a length of the thrust groove 22 along the axial direction of the piston 2, the L2 is a diameter of the limiting piece 52, and the S is a stroke of the piston 2 slid in the cylinder 1.

While L1−L2=S, and the piston 2 is slid to a destination position of the stroke in the piston hole 11, a side wall of the thrust groove 22 and an outer side wall of the limiting piece are just located in a limit position of non-contact, at this moment, the piston 2 does not collide with the limiting piece 52. While L1−L2>S, and the piston 2 is reciprocated to be slid in the piston hole 11, the side wall of the thrust groove 22 does not contact with the outer side wall of the limiting piece 52 always, therefore the piston 2 does not collide with the limiting piece 52, and the compressor is worked more stably and reliably.

Figure 5A:
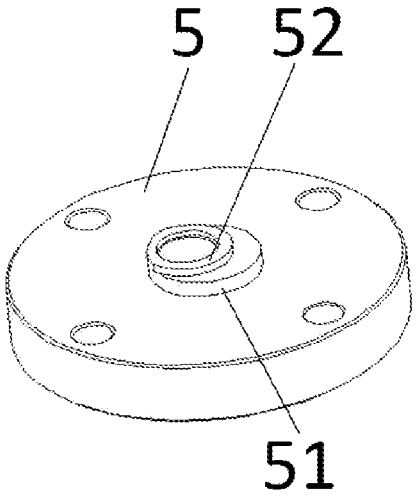
FIG. 5A and FIG. 5B are a lower flange structure schematic diagram in some embodiments of the disclosure.
Figure 5B:
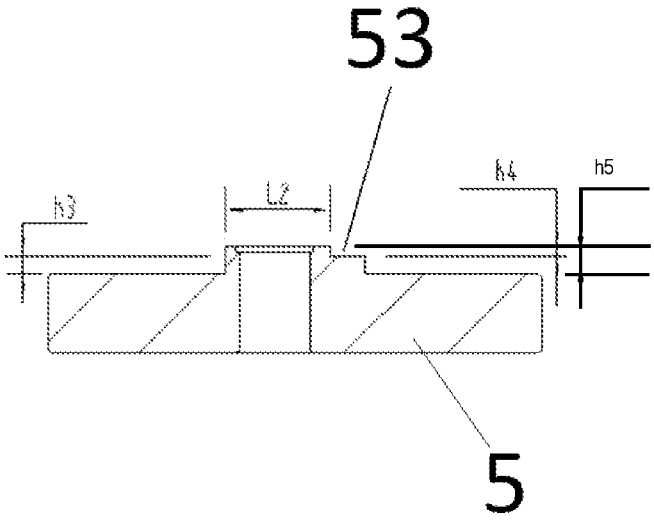
Figure 6:
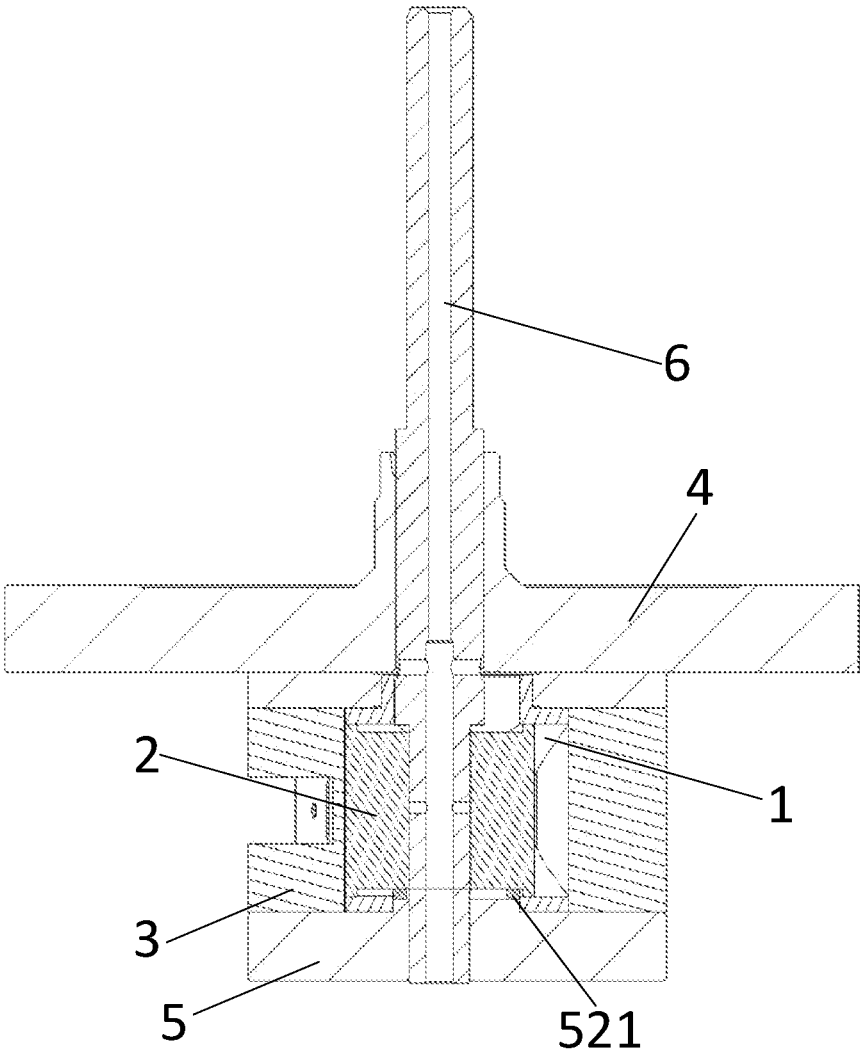
FIG. 6 is a piston limiting structure assembly section view in a second embodiment of the disclosure.
Figure 7A:
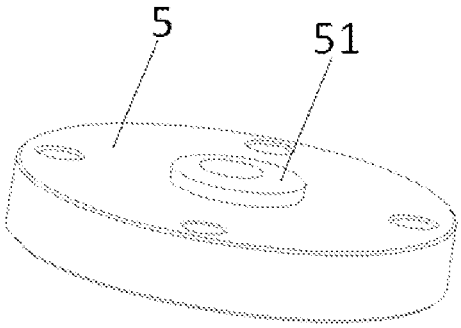
FIG. 7A and FIG. 7B are a lower flange structure schematic diagram in the second embodiment of the disclosure.
Figure 7B:
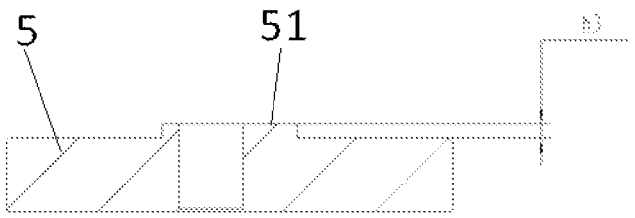
Figure 8A:
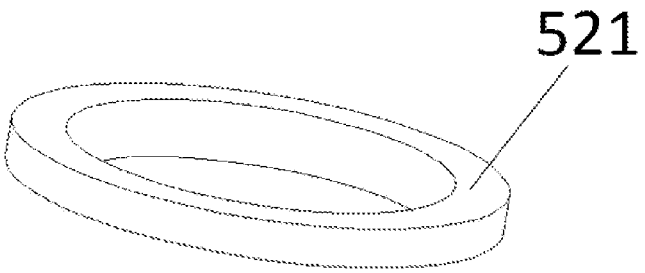
FIG. 8A and FIG. 8B are a limiting ring structure schematic diagram in the second embodiment of the disclosure.
Figure 8B:
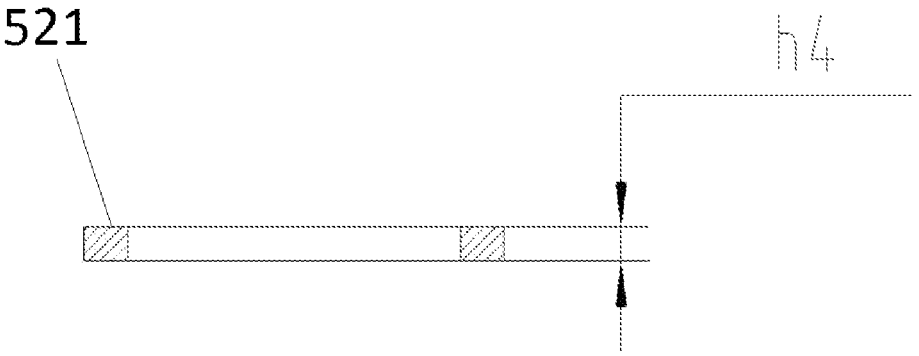

On this basis, a diameter of the limiting piece 52 is set to be less than a diameter of the lug boss 51, thus an avoidance space 53 is formed on the lug boss 51. As shown in FIG. 5A and FIG. 5B, in some embodiments, the limiting piece 52 and the lug boss 51 are arranged in an internally tangent manner, and the crescent-shaped avoidance space 53 is formed on the lug boss 51. The length $L_1$ of the thrust groove 22 is effectively reduced by reducing the length $L_2$ of the limiting piece 52, thereby a sealing distance between the piston 2 and an inner wall of the cylinder 1 is increased correspondingly, so that a sealing effect between the piston 2 and the inner wall of the cylinder 1 is better. At the same time, under a precondition of satisfying a minimum sealing distance requirement, diameters of the piston 2 and the cylinder 1 are correspondingly designed to be reduced, so the mechanical power consumption of the compressor is reduced.

In some embodiments, as shown in FIG. 3A to FIG. 5B, $h_1$ is a groove depth of the thrust groove 22, $h_2$ is a shortest distance from the piston hole 11 of the cylinder 1 to the end face of the cylinder 1, $h_3$ is a height of the lug boss 51, $h_4$ is a height of the limiting piece 52, and $h_5$ is a height from an upper end face of the limiting piece to an upper end face of the lower flange 5, namely $h_5=h_3+h_4$ in some embodiments. At the same time, while the lower flange 5 is assembled with the cylinder 1, in order to avoid the upper end face of the lug boss 51 of the lower flange 5 from interfering a motion of the piston 2, the height of the lug boss 51 should not be greater than the shortest distance from a bottom portion of the piston hole 11 of the cylinder 1 to the end face of the cylinder 1, namely h2≥h3, the height of the lug boss 51 does not exceed the cylinder 1 and enter the piston hole 11 to interfere with the motion of the piston 2.

While the upper end face of the limiting piece 52 abuts against the thrust surface 221, it is satisfied:

$$h_1+h_2=h_3+h_4$$

At this moment, the upper end face of the limiting piece 52 and the thrust surface 221 are located in a critical position of abutting, there is no vertical acting force between two planes, and the piston 2 is limited by the limiting piece 52 at the same time, the piston 2 is prevented from being auto-rotated.

While the upper end face of the limiting piece 52 abuts against the thrust surface 221, it is satisfied:

$$h_1+h_2>h_3+h_4$$

At this moment, a minute clearance A exists between the upper end face of the limiting piece 52 and the thrust surface 221 of the piston 2, while the piston 2 has a tendency to auto-rotate, the thrust surface 221 of the piston 2 is inclined and contacts with the end face of the limiting piece 52, an effect of limiting the auto-rotation of the piston 2 is achieved, because the fit clearance A is small enough, an auto-rotation angle of the piston 2 is small, and the piston 2 does not collide with the cylinder sleeve 3. It is to be noted that, in this case, a certain minute clearance A exists between the piston 2 and the limiting piece 52, $\Delta \leq 0.05$ mm, therefore the auto-rotation tendency of the piston 2 is very small, it is not enough to collide a cylinder wall at a compression end portion. However, for assembly, because there may be an assembly clearance between the piston 2 and the limiting piece 52, machining and assembling accuracy requirements to the thrust surface 221 of the piston 2 and the limiting piece 52 are lower, a machining cost is correspondingly reduced, and large-scale machining and production are easy.

While the upper end face of the limiting piece 52 abuts against the thrust surface 221, it is satisfied:

$$h_1+h_2<h_3+h_4$$

At this moment, the piston 2 is jacked up to a certain small height $\eta$ by the limiting piece 52, gravities of the piston 2 and the cylinder 1 need to be loaded by the limiting piece 52, the piston 2 is limited to be auto-rotated by the own gravity of the piston 2, and the limiting effect is better. At the same time, clearances between the upper and lower side walls of the piston 2 and the cylinder 1 are adjusted by adjusting a numerical range of the $\eta$, $\eta \leq 0.05$ mm, a numerical value of the $\eta$ is adjusted by finish machining, so that the assembly accuracy of the piston 2 and the cylinder 1 is higher, thereby the fit clearances between the upper and lower side walls of the piston 2 and the inner wall of the cylinder 1 are the same, the work of the piston 2 is more stable and reliable, and it is beneficial to lubrication of an oil path, so the friction power consumption is reduced.

FIG. 6 to FIG. 9 show a second embodiment of the piston limiting structure of the disclosure, in some embodiments, the piston 2 is connected with the lower flange 5 by using an inner circle support structure. The limiting piece 52 and the lower flange 5 are arranged as a split-type structure.

Figure 9:
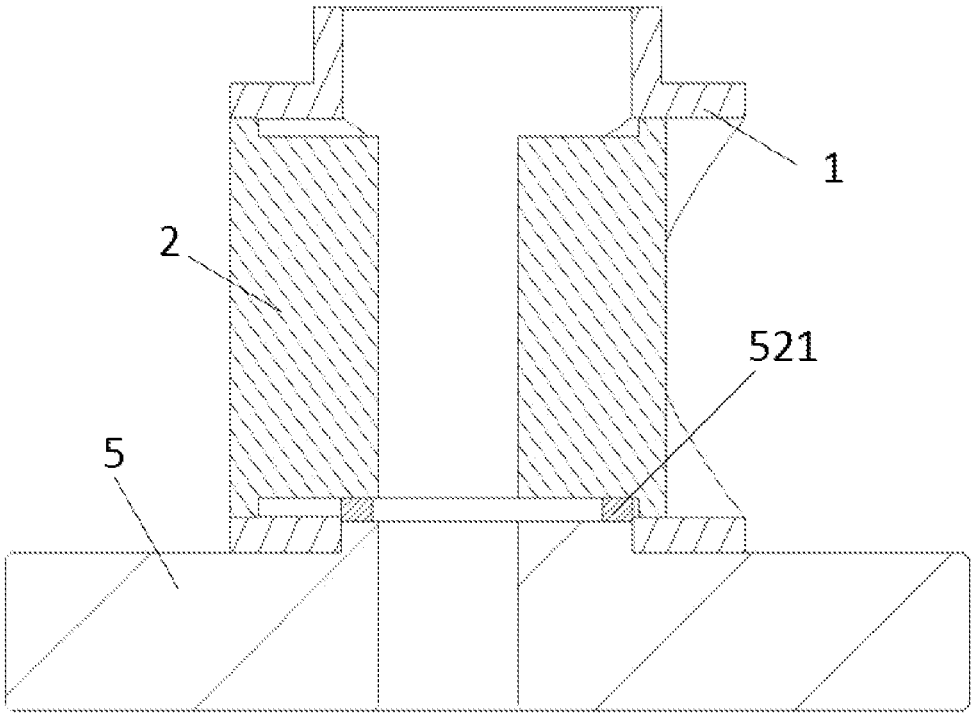
FIG. 9 is a section view of a piston limiting structure in the second embodiment of the disclosure.

As shown in FIG. 6, FIG. 7A, FIG. 7B, FIG. 8A and FIG. 8B, the cylindrical lug boss 51 is formed in the middle of the upper end face of the lower flange 5, the lug boss 51 is provided with a limiting ring 521, the limiting ring 521 is a hollow cylinder structure, and an inner circle is an avoidance through hole of the rotation shaft 6, so that a lower short shaft of the rotation shaft 6 passes through the limiting ring 521. A lower end face of the limiting ring 521 abuts against the lug boss 51, and an upper end face abuts against the thrust surface 221 of the piston 2, thereby the auto-rotation of the piston 2 is limited. In some embodiments, as shown in FIG. 9, a diameter of the limiting ring 521 is equal to a diameter of the lug boss 51, thereby a side wall is flush with a side wall of the lug boss 51 while the limiting ring 521 is mounted on the lug boss 51, a part of a lower portion of an outer side wall of the limiting ring 521 is arranged to abut against a side wall of the assembling hole 12 of the cylinder 1, and coaxially assembled with the cylinder 1, thereby the limiting ring 521 is radially limited by the cylinder 1, and the limiting ring 521 is avoided from being radially moved in the rotation reciprocating motion process of the piston 2. The limiting ring 521 is rotated in a rotation process of the cylinder 1 and the piston 2, thereby the friction power consumption between the limiting ring 521 and the thrust surface 221 of the piston 2 is effectively reduced. At the same time, in some embodiments, the limiting ring 521 is made of a wear-resistant and anti-friction material, so the friction power consumption is further reduced. Because of the split-type structure of the limiting ring 521 and the lower flange 5, the lower flange 5 does not need to adopt an anti-friction material, the cost is reduced.

In the embodiments, other structures and working principles of the piston limiting structure are the same as the above embodiments, so it is not repeatedly described here.

Figure 10:
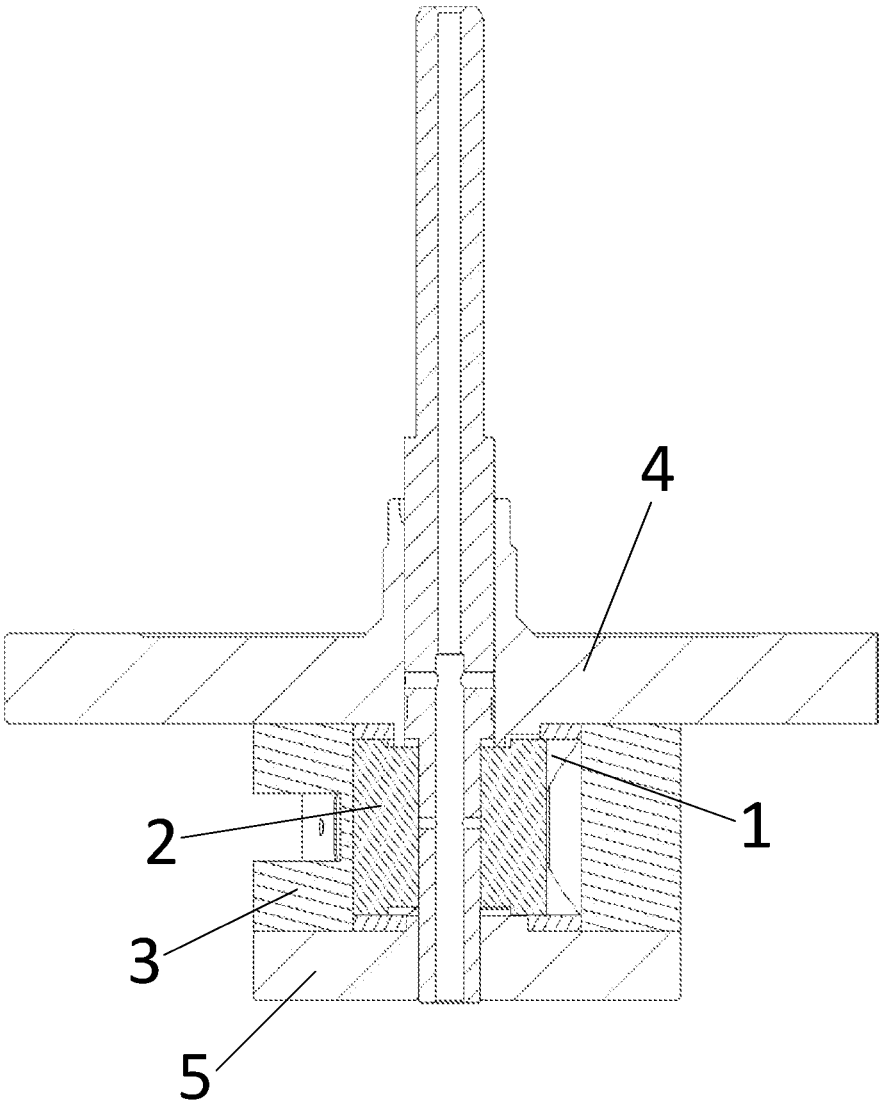
FIG. 10 is a piston limiting structure assembly section view in a third embodiment of the disclosure.
Figure 11:
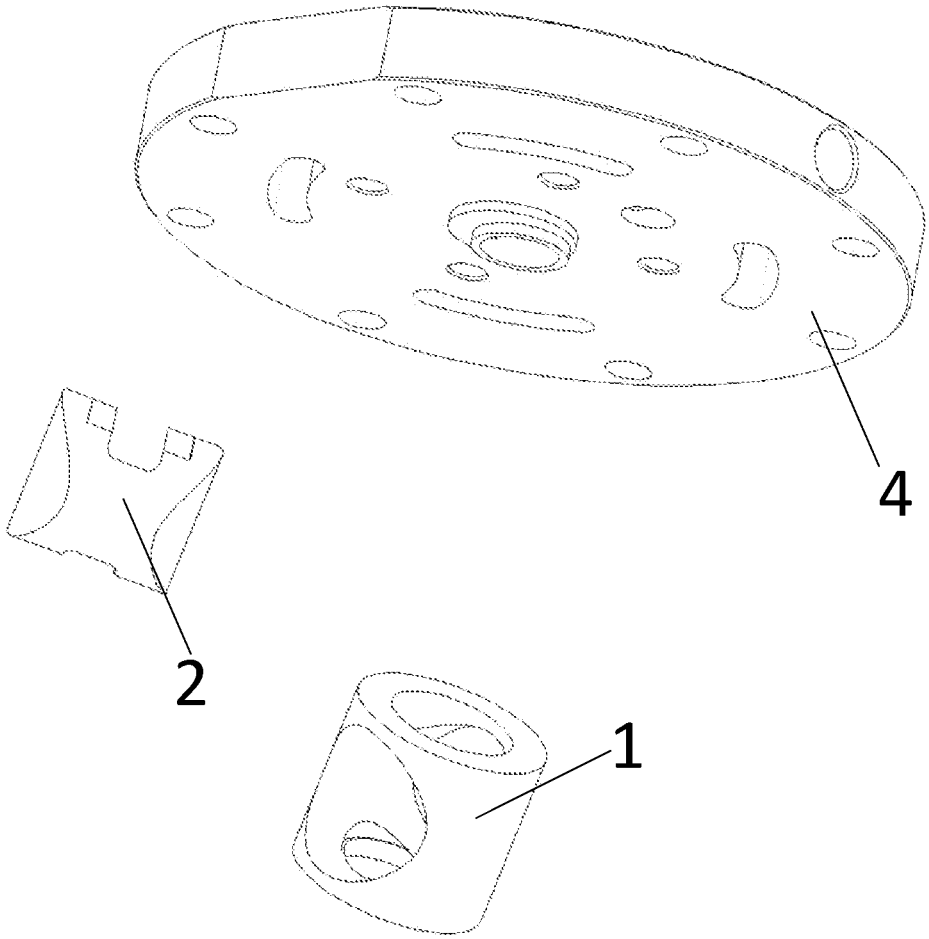
FIG. 11 is an exploded diagram of the piston limiting structure in the third embodiment of the disclosure.

FIG. 10 and FIG. 11 show a third embodiment of the piston limiting structure of the disclosure, in some embodiments, the lug boss 51 and the limiting piece 52 are disposed on the lower end face of the upper flange 4, the limiting piece 52 is integrally formed with the lug boss 51, the thrust surface 221 of the piston 2 is correspondingly arranged in a position of the upper side wall, the piston 2 is limited by the upper flange 4, and principles are the same as above.

Figure 12:
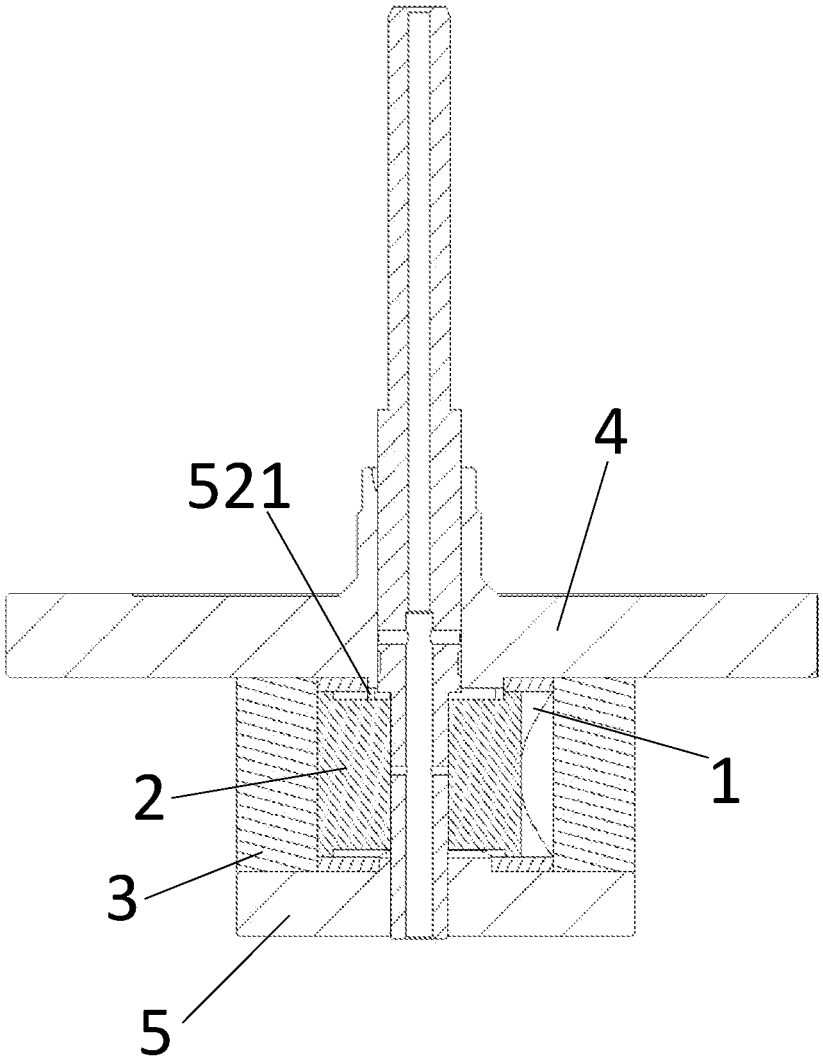
FIG. 12 is a piston limiting structure assembly section view in a fourth embodiment of the disclosure.
Figure 13:
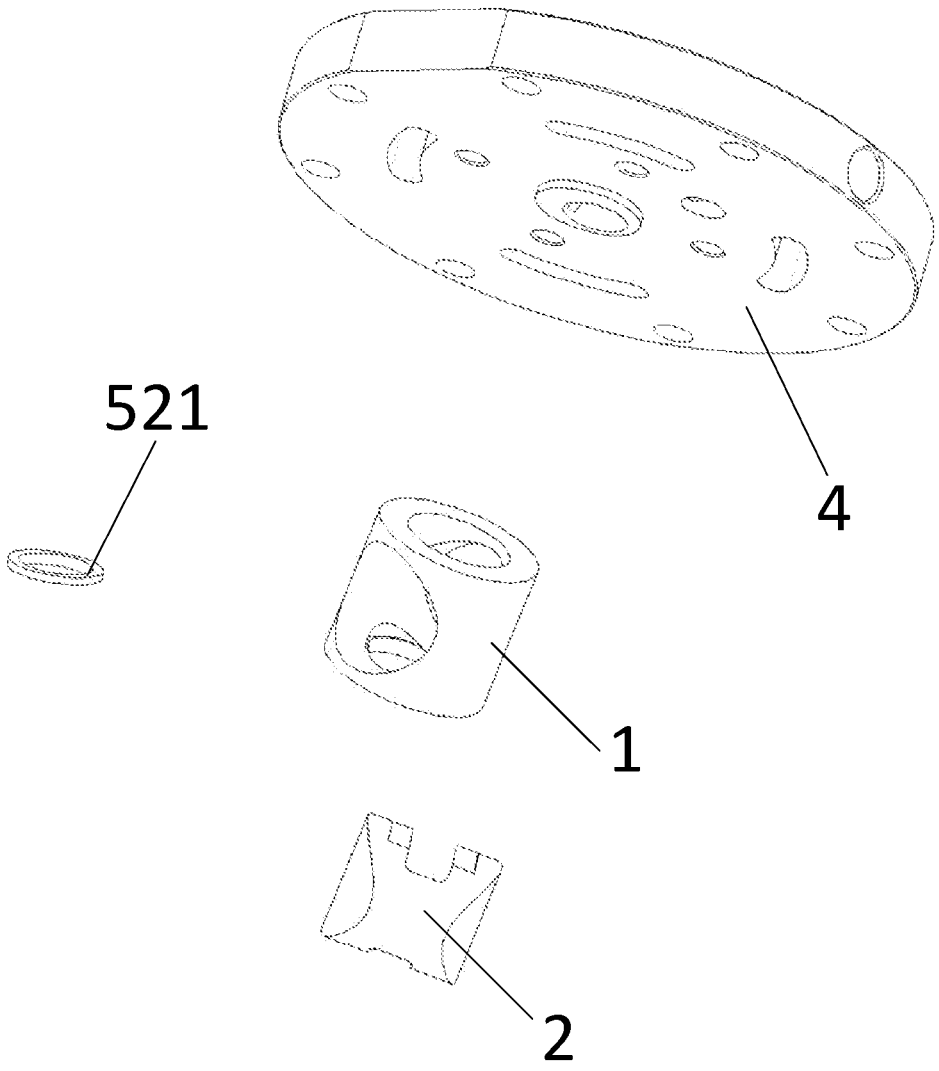
FIG. 13 is an exploded diagram of the piston limiting structure in the fourth embodiment of the disclosure.

FIG. 12 and FIG. 13 show a fourth embodiment of the piston limiting structure of the disclosure, in some embodiments, the lug boss 51 and the limiting piece 52 are disposed on the lower end face of the upper flange 4, the limiting piece 52 includes a limiting ring 521, and the limiting ring 521 is arranged as the split-type structure with the upper flange 4, the thrust surface 221 of the piston 2 is correspondingly arranged in the position of the upper side wall, the piston 2 is limited by the upper flange 4, and principles are the same as above.

Figure 14:
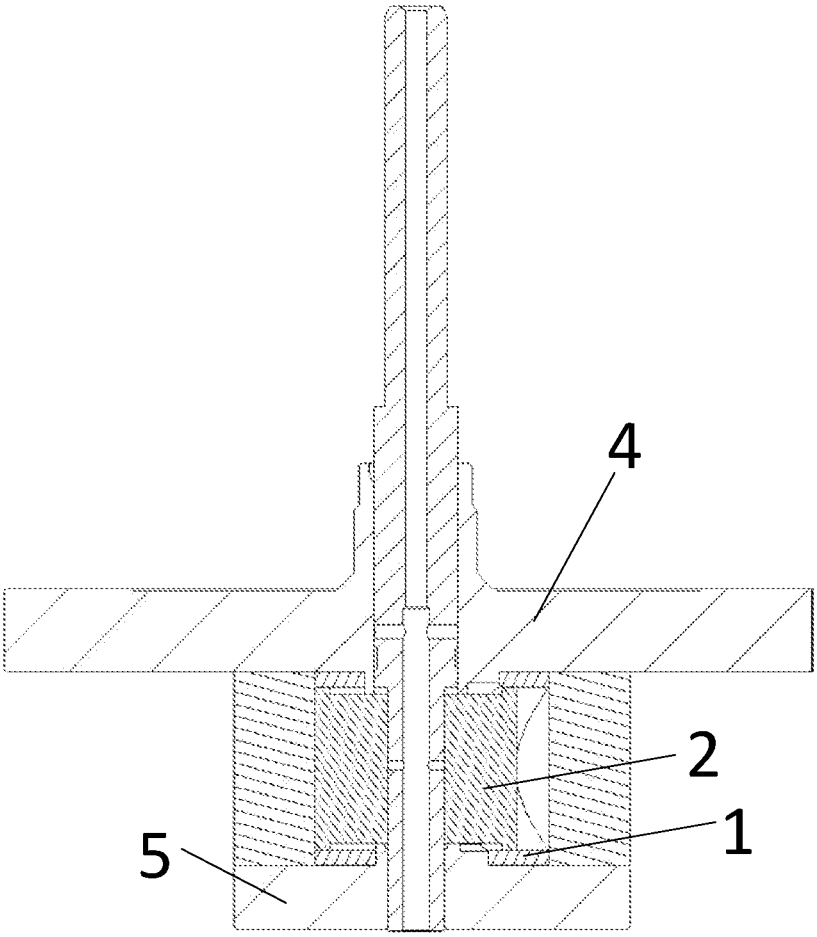
FIG. 14 is a piston limiting structure assembly section view in a fifth embodiment of the disclosure.

FIG. 14 shows a fifth embodiment of the piston limiting structure of the disclosure, in some embodiment, the lug boss 51 and the limiting piece 52 are respectively arranged on the upper flange 4 and the lower flange 5, the limiting piece 52 is integrally formed with the lug boss 51, the thrust surface 221 of the piston 2 is correspondingly arranged at upper and lower two sides of the side wall, the piston 2 is limited by the upper and lower flanges simultaneously, the limiting effect is better, working principles are the same as above, and it is not repeatedly described in the implementation mode.

Figure 15:
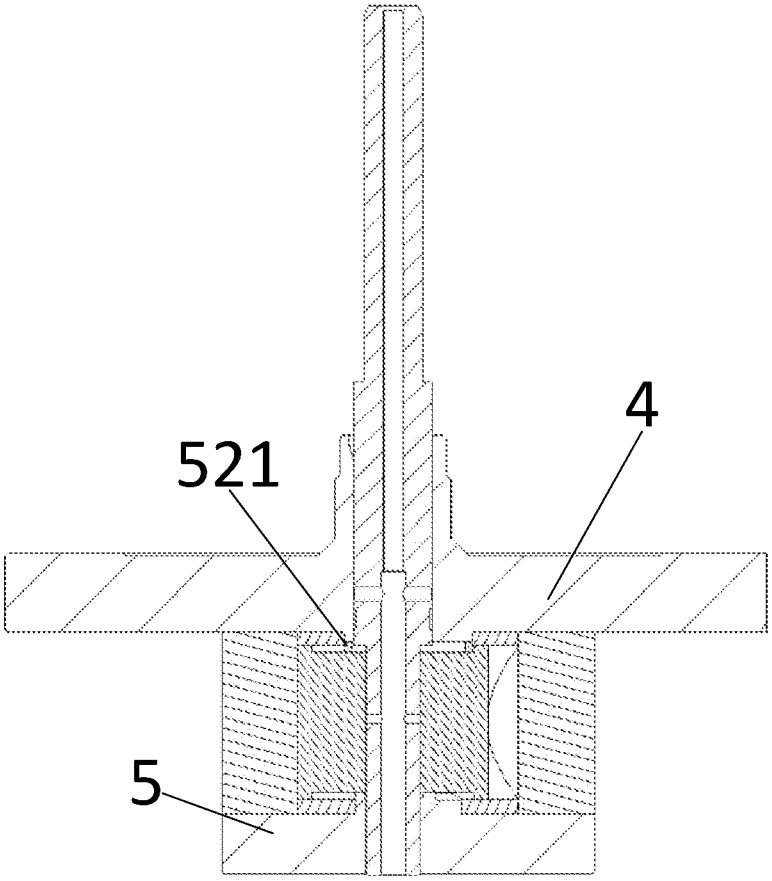
FIG. 15 is a piston limiting structure assembly section view in a sixth embodiment of the disclosure.

FIG. 15 shows a sixth embodiment of the piston limiting structure of the disclosure, in some embodiments, the upper and lower flanges are both provided with the lug bosses 51, at the same time the lug boss 51 of the upper flange 4 is provided with the limiting ring 521, the limiting piece 52 is formed on the lug boss 51 of the lower flange 5, the thrust surface 221 of the piston 2 is correspondingly arranged at the upper and lower two sides of the side wall, working principles are the same as above.

Figure 16:
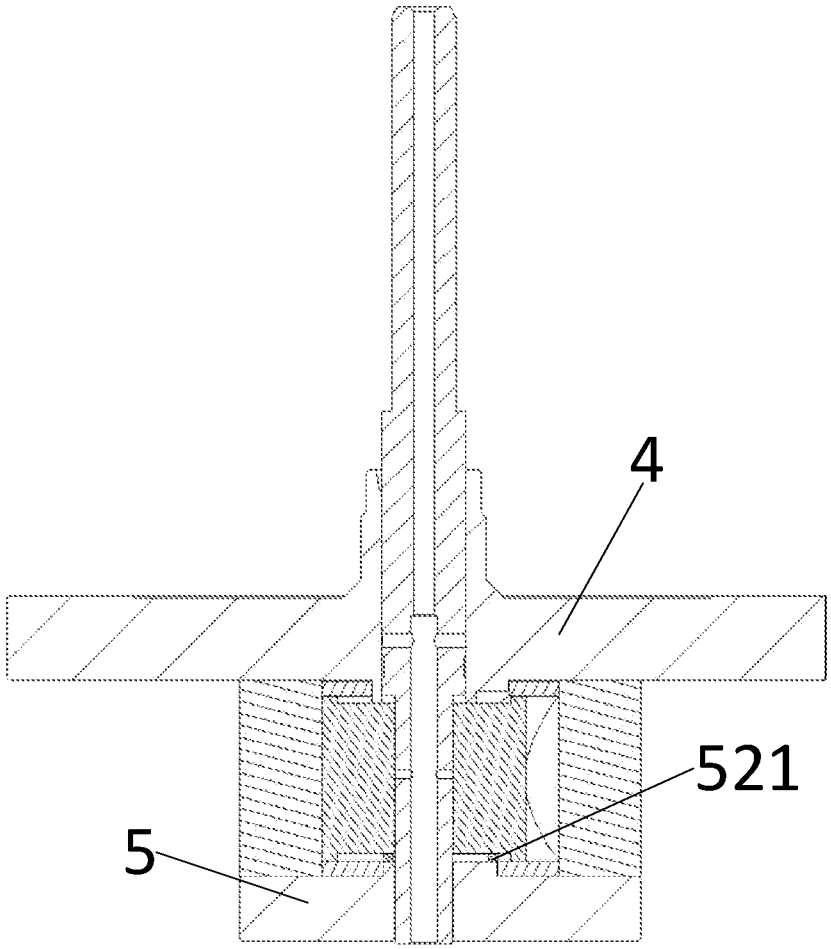
FIG. 16 is a piston limiting structure assembly section view in a seventh embodiment of the disclosure.

FIG. 16 shows a seventh embodiment of the piston limiting structure of the disclosure, in some embodiments, the upper and lower flanges are both provided with the lug bosses 51, at the same time the limiting piece 52 is formed on the lug boss 51 of the upper flange 4, the lug boss 51 of the lower flange 5 is provided with the limiting ring 521, the thrust surface 221 of the piston 2 is correspondingly arranged at the upper and lower two sides of the side wall, working principles are the same as above.

Figure 17:
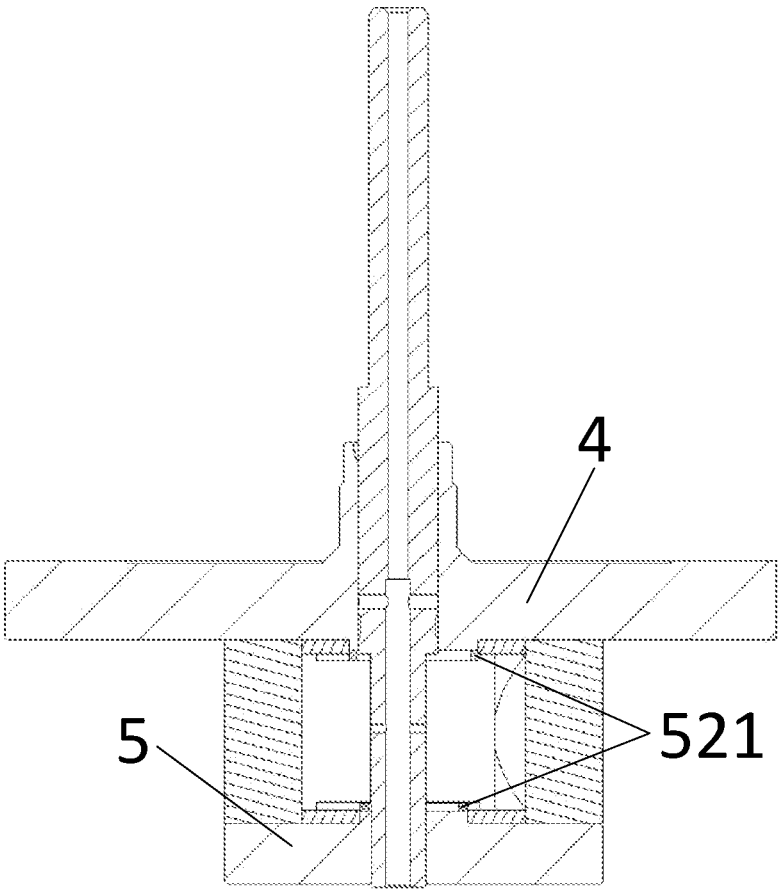
FIG. 17 is a piston limiting structure assembly section view in an eighth implementation mode of the disclosure.

FIG. 17 shows an eighth embodiment of the piston limiting structure of the disclosure, in some embodiments, the upper and lower flanges are both provided with the lug boss 51 and the limiting ring 521, the thrust surface 221 of the piston 2 is correspondingly arranged at the upper and lower two sides of the side wall, working principles are the same as above, and it is not repeatedly described here.

Figure 18:
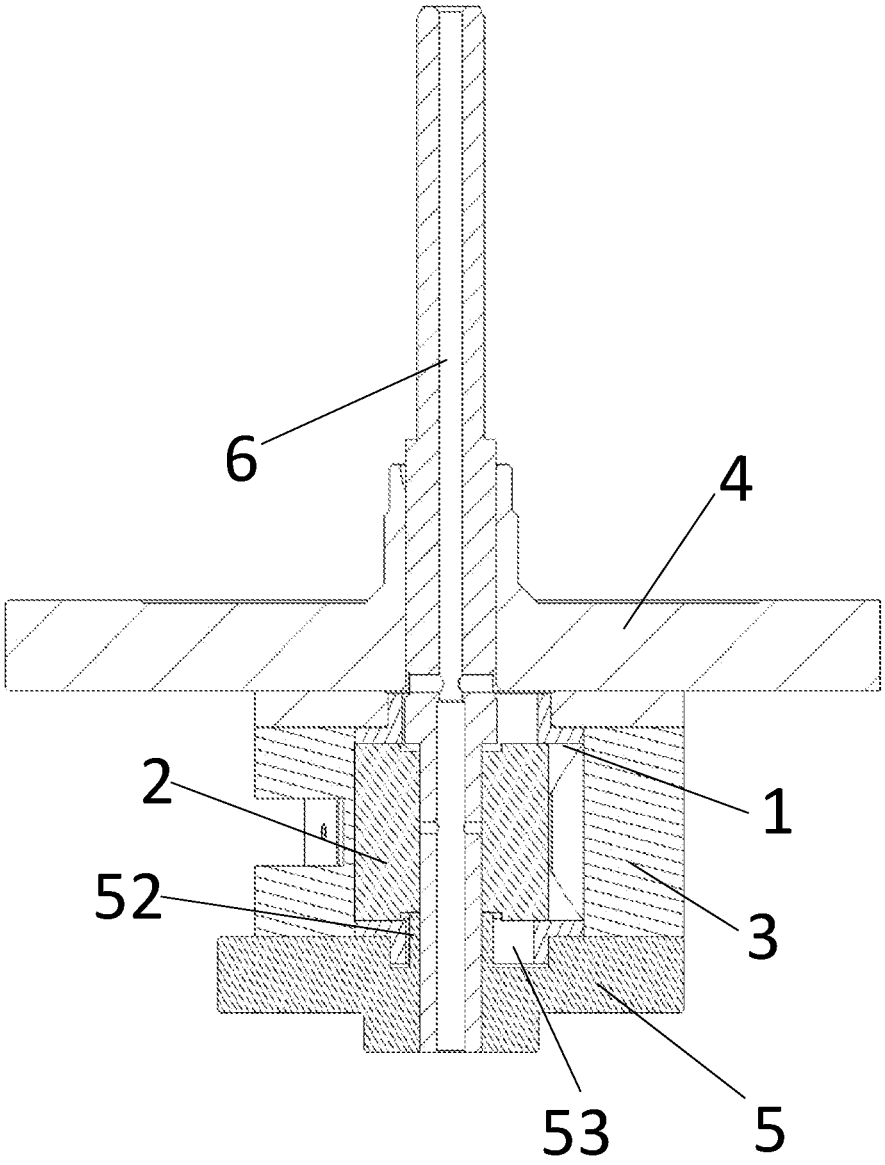
FIG. 18 is a piston limiting structure assembly section view in a ninth implementation mode of the disclosure.
Figure 19:
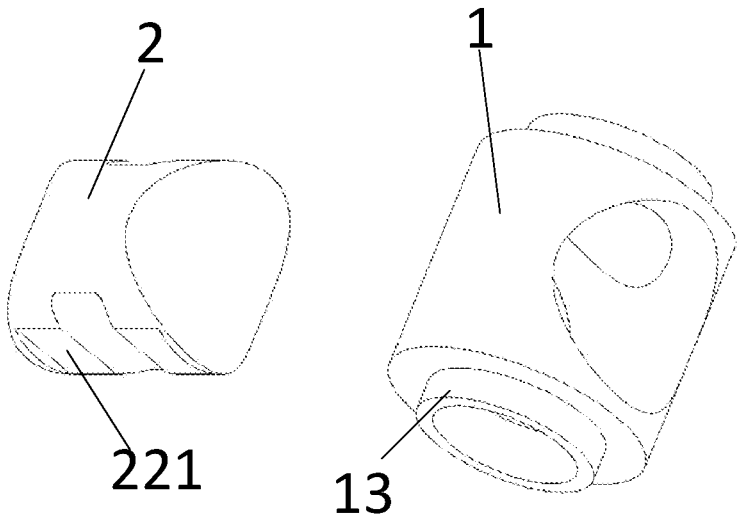
FIG. 19 is a structure schematic diagram of a piston and a cylinder in the ninth implementation mode of the disclosure.
Figure 20A:
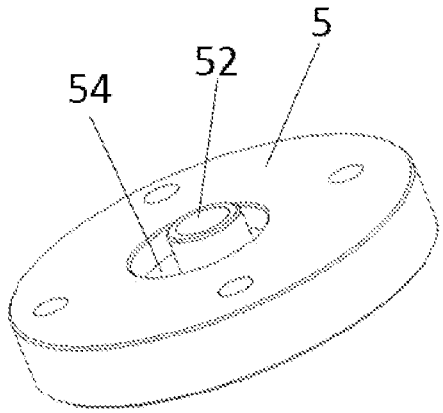
FIG. 20A and FIG. 20B are a structure schematic diagram of a lower flange in the ninth implementation mode of the disclosure.
Figure 20B:
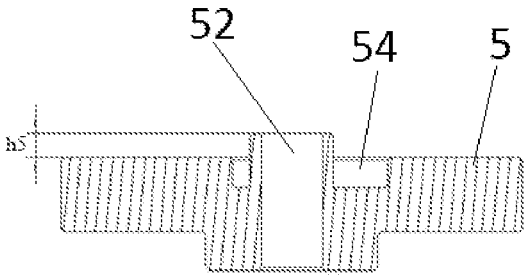

FIG. 18 to FIG. 20 show a ninth embodiment of the piston limiting structure of the disclosure, in some embodiments, the lower flange 5 is connected with the cylinder 1 by using an outer circle support structure.

As shown in FIG. 18 to FIG. 20, a middle portion of the lower flange 5 is provided with a circular sink groove 54, the lower end face of the cylinder 1 is provided with a cylindrical short shaft 13 protruded outwards, the short shaft 13 is insertion-connected with the sink groove 54, an outer wall of the short shaft 13 abuts against an inner wall of the sink groove 54, thereby an outer circle limiting structure is formed to the cylinder 1. A height of the short shaft 13 is less than or equal to a depth of the sink groove 54, so that the end face of the cylinder 1 abuts against the end face of the lower flange 5 while the short shaft 13 is cooperated with the sink groove 54, in some embodiments, two parties are equal to reduce the friction power consumption between the cylinder 1 and the lower flange 5. The cylindrical limiting piece 52 is formed in the sink groove 54 of the lower flange, and a middle portion of the limiting piece 52 is the penetrating shaft hole. The axial direction of the cylinder 1 is provided with the penetrating assembling hole 12, while the cylinder 1 is cooperated with the lower flange 5, the limiting piece 52 is located in the assembling hole 12, and the upper end face of the limiting piece 52 abuts against the thrust surface 221, thereby the auto-rotation of the piston 2 is limited.

In some embodiments, the $h_1$ is a groove depth of the thrust groove 22, the $h_2$ is the shortest distance from the piston hole 11 of the cylinder 1 to the end face of the cylinder 1, and the $h_5$ is a height from the upper end face of the limiting piece 52 to the upper end face of the lower flange 5, while the upper end face of the limiting piece 52 abuts against the thrust surface 221, it is satisfied:

$$h_1+h_2=h_5$$

At this moment, the upper end face of the limiting piece 52 and the thrust surface 221 are located in the critical position of abutting, there is no vertical acting force between two mutual planes, at the same time the piston 2 is limited by the limiting piece 52, and the piston 2 is prevented from being auto-rotated.

While the upper end face of the limiting piece 52 abuts against the thrust surface 221, it is satisfied:

$$h_1+h_2>h_5$$

At this moment, a minute clearance A exists between the upper end face of the limiting piece 52 and the thrust surface 221 of the piston 2, while the piston 2 has a tendency to auto-rotate, the thrust surface 221 of the piston 2 is inclined and contacts with the end face of the limiting piece 52, an effect of limiting the auto-rotation of the piston 2 is achieved, because the fit clearance A is small enough, an auto-rotation angle of the piston 2 is small, and the piston 2 does not collide with the cylinder sleeve 3. It is to be noted that, in this case, a certain minute clearance A exists between the piston 2 and the limiting piece 52, $\Delta \leq 0.05$ mm, therefore the auto-rotation tendency of the piston 2 is very small, it is not enough to collide a cylinder wall at a compression end portion. However, for assembly, because there may be an assembly clearance between the piston 2 and the limiting piece 52, machining and assembling accuracy requirements to the thrust surface 221 of the piston 2 and the limiting piece 52 are lower, a machining cost is correspondingly reduced, and large-scale machining and production are easy.

While the upper end face of the limiting piece 52 abuts against the thrust surface 221, it is satisfied:

$$h_1+h_2<h_5$$

At this moment, the piston 2 is jacked up to a certain small height $\eta$ by the limiting piece 52, gravities of the piston 2 and the cylinder 1 need to be loaded by the limiting piece 52, the piston 2 is limited to be auto-rotated by the own gravity of the piston 2, and the limiting effect is better. At the same time, a clearances between the upper side wall of the piston 2 and the cylinder 1 and a clearances between the lower side wall of the piston 2 and the cylinder 1 are adjusted by adjusting a numerical range of the $\eta$, $\eta \leq 0.05$ mm, a numerical value of the $\eta$ is adjusted by finish machining, so that the assembly accuracy of the piston 2 and the cylinder 1 is higher, thereby the fit clearances between the upper and lower side walls of the piston 2 and the inner wall of the cylinder 1 are the same, the work of the piston 2 is more stable and reliable, and it is beneficial to lubrication of an oil path, so the friction power consumption is reduced.

In some embodiments, a limiting principle of the lower flange 5 and the piston 2 is the same as the embodiments, and it is not repeatedly described here.

Figure 21:
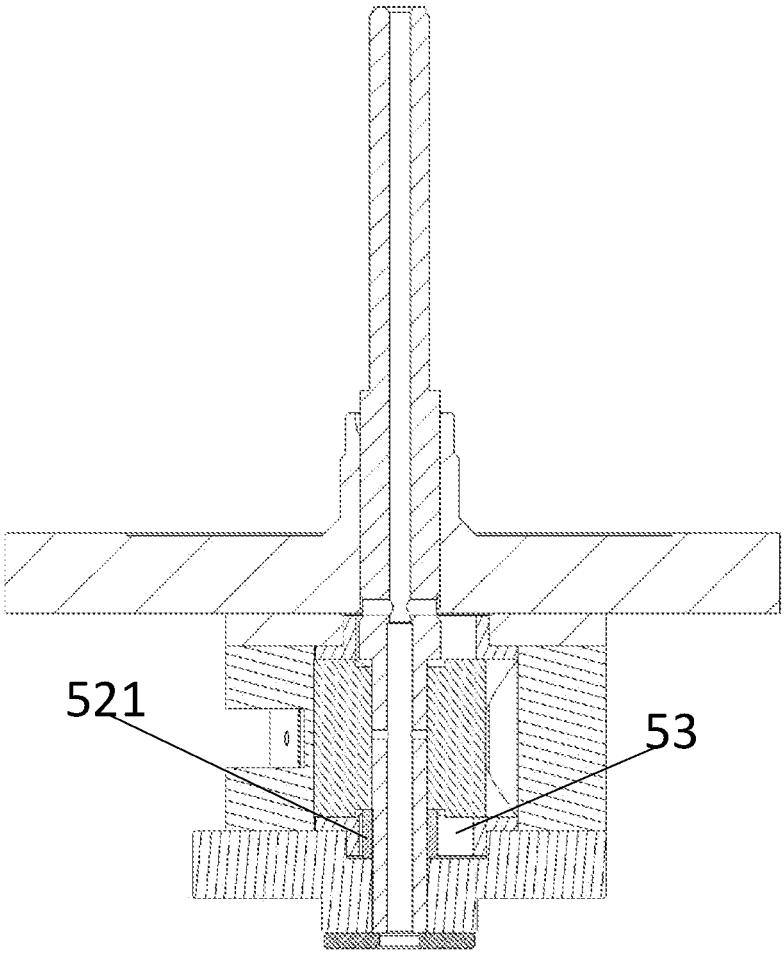
FIG. 21 is a piston limiting structure assembly section view in a tenth implementation mode of the disclosure.
Figure 22A:
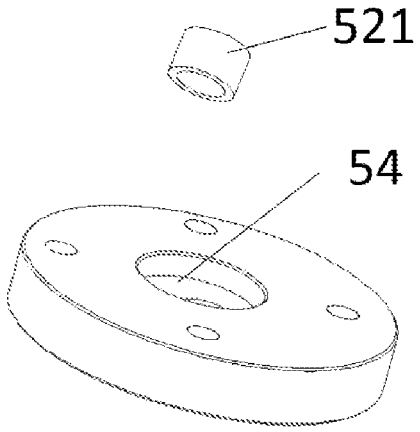
FIG. 22A and FIG. 22B are a structure schematic diagram of a limiting ring and a lower flange in the tenth implementation mode of the disclosure.
Figure 22B:
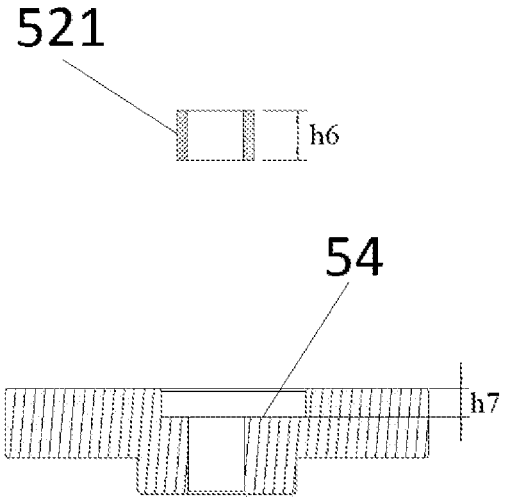

FIG. 21, FIG. 22A and FIG. 22B show a tenth embodiment of the piston limiting structure of the disclosure, in some embodiments, the lower flange 5 is connected with the cylinder 1 by using the outer circle support structure, at the same time the limiting piece 52 and the lower flange 5 are arranged as the split-type structure, and the limiting piece 52 includes a structure of the limiting ring 521.

In the embodiments, a lower end face of the limiting ring 521 abuts against an upper end face of the sink groove 54 of the lower flange 5, and an upper end face of the limiting ring 521 abuts against the thrust surface 221 of the piston, thereby the auto-rotation of the piston 2 is limited. As shown in FIG. 21, $h_6$ is an axial height of the limiting ring 521, and $h_7$ is a height of the sink groove 54 of the lower flange 5, therefore while the limiting ring 521 abuts against the thrust surface 221, it is satisfied:

$$h_6-h_7=h_5$$

On this basis, a relation between the $h_5$ and the $h_1$ and $h_2$ is as described in the above embodiments, and is not repeatedly described here.

It is to be noted that, in the embodiments, an inner diameter of the limiting ring 521 is matched with a section diameter of the rotation shaft 6, thereby the limiting ring 521 is radially limited by the rotation shaft 6, the piston 2 is avoided from colliding with the limiting ring 521 in the reciprocating rotation motion, and an avoidance space 53 is formed between the assembling hole 12 of the cylinder 1 and the limiting ring 521, the beneficial effects are as described above. In some embodiments, the outer diameter of the limiting ring 521 is the same as the diameter of the assembling hole 12, thereby the limiting ring 521 is limited by the inner wall of the assembling hole 12 of the cylinder 1.

On the basis of the above embodiments, the piston limiting structure of the disclosure may also have other replaceable embodiments.

In an eleventh embodiment, the upper flange and the upper short shaft of the cylinder adopt the outer circle support structure, at the same time the limiting structure as in the ninth or tenth embodiment is adopted between the upper flange and the cylinder.

In a twelfth embodiment, the upper and lower flanges and the upper and lower short shafts of the cylinder all adopt the outer circle support structure, at the same time one or arbitrary combinations of the limiting structures as in the ninth and tenth embodiments are adopted.

In a second aspect, some embodiments of the disclosure further provide a compressor, as shown in FIG. 1, the compressor of the embodiments of the disclosure include a rotation shaft 6, an upper flange 4, a lower flange 5, a cylinder sleeve 3, and the above piston limiting structure, the cylinder 1 is arranged in the cylinder sleeve 3, the rotation shaft 6 successively passes through the upper flange 4, the cylinder sleeve 3 and the lower flange 5. The compressor of some embodiments of the disclosure is based on the cross-head shoe principle, as shown in FIG. 2, while the compressor is worked, the rotation shaft 6 abuts against the wall surface of the shaft hole 21 of the piston 2 so that the piston 2 and the cylinder 1 are driven to be rotated in the cylinder sleeve 3, because of an eccentric rotation of the rotation shaft 6 and the cylinder 1, the piston 2 is reciprocated relative to the cylinder 1, thereby a gas is compressed in a volume chamber at two ends of the piston 2. In some embodiments of the disclosure, through arranging the flange and the piston liming structure, the piston of the compressor is effectively avoided from being auto-rotated to cause the collision to the cylinder.

In a third aspect, some embodiments of the disclosure further provide a heat exchange apparatus, and the heat exchange apparatus includes the above compressor or piston limiting structure. The heat exchange apparatus is an air conditioner or a refrigerator.

Apparently, the above embodiments are merely examples for clear description, and are not intended to limit the implementation modes. Other changes or modifications in different forms may be made on the basis of the above description by those of ordinary skill in the art. There is no need and may not be an exhaustive list of all of the implementation modes. The apparent changes or modifications derived from this are still within the scope of protection of the present disclosure.

What is claimed is:

1. A piston limiting structure, comprising:

a cylinder, having a piston hole perpendicular to an axial direction of the cylinder and penetrating through the cylinder, wherein a projection of the piston hole in a penetrating direction is circular;

a piston, disposed in the piston hole in a form-fit manner and slid in the piston hole in a reciprocating manner, wherein a side wall of the piston is provided with a thrust groove, a bottom surface of the thrust groove forms a thrust surface on the side wall of the piston, and the thrust groove does not penetrate through two ends of the side wall of the piston along an axial length of the piston; and a flange, provided with a limiting piece, wherein the limiting piece abuts against the thrust surface to limit the piston to be rotated around an axis of the piston itself.

2. The piston limiting structure according to claim 1, wherein, the thrust surface is perpendicular to the axial direction of the cylinder.

3. The piston limiting structure according to claim 2, wherein, the flange comprises a lug boss, an end face of the cylinder is provided with an assembling hole penetrating to the piston hole, the lug boss and the assembling hole are insertion-connected in the form-fit manner, so that the end face of the cylinder abuts against an end face of the flange, and the cylinder is rotation-connected with the flange, the limiting piece is disposed on the lug boss, an end face at one side of the limiting piece abuts against the thrust surface to limit the piston to be rotated around the axis of the piston itself.

4. The piston limiting structure according to claim 3, wherein, while the lug boss is cooperated with the assembling hole, it is satisfied:

$$h_2 \geq h_3$$

wherein, the $h_2$ is a distance from a piston hole endpoint along the axial direction of the cylinder to a bottom face of the cylinder and the $h_3$ is a height of the lug boss along the axial direction of the cylinder.

5. The piston limiting structure according to claim 4, wherein, while the end face at one side of the limiting piece abuts against the thrust surface, it is satisfied:

$$h_1+h_2 \geq h_5$$

wherein, the $h_1$ is a groove depth of the thrust groove, the $h_2$ is the distance from the piston hole endpoint along the axial direction of the cylinder to the bottom face of the cylinder, and the $h_5$ is a height from the end face at one side of the limiting piece to an end face at one side, adjacent to the limiting piece, of the flange, and a difference between a value of $h_5$ and $h_1+h_2$ is 0-0.05 mm.

6. The piston limiting structure according to claim 4, wherein, while the end face at one side of the limiting piece abuts against the thrust surface, it is satisfied:

$$h_1+h_2 \geq h_5$$

wherein, the $h_1$ is a groove depth of the thrust groove, the $h_2$ is the distance from the piston hole endpoint along the axial direction of the cylinder to the bottom face of the cylinder, and the $h_5$ is a height from the end face at one side of the limiting piece to an end face at one side, adjacent to the limiting piece, of the flange, and a difference between a value of $h_5$ and $h_1+h_2$ is 0-0.05 mm.

7. The piston limiting structure according to claim 2, wherein, the flange is provided with a sink groove, the end face of the cylinder is provided with a short shaft protruded outwardly, the short shaft is insertion-connected with the sink groove in the form-fit manner, so that the end face of the cylinder abuts against the end face of the flange, and the cylinder is rotation-connected with the flange, an end face of the short shaft is provided with an assembling hole penetrating to the piston hole, the limiting piece is disposed in the assembling hole, an end face at one side of the limiting piece abuts against the thrust surface to limit the piston to be rotated around the axis of the piston itself.

8. The piston limiting structure according to claim 7, wherein, while the end face at one side of the limiting piece abuts against the thrust surface, it is satisfied:

$$h_1+h_2 \geq h_5$$

wherein, the $h_1$ is a groove depth of the thrust groove, the $h_2$ is a distance from a piston hole endpoint along the axial direction of the cylinder to a bottom face of the cylinder, and the $h_5$ is a height from the end face at one side of the limiting piece to an end face at one side, adjacent to the limiting piece, of the flange, and a difference between a value of $h_5$ and $h_1+h_2$ is 0-0.05 mm.

9. The piston limiting structure according to claim 1, wherein, the thrust groove is disposed in a position of ½ of the axial direction of the piston.

10. The piston limiting structure according to claim 9, wherein, while the piston is reciprocated to be slid in the piston hole, it is satisfied:

$$L_1-L_2 \geq S$$

wherein, the $L_1$ is a length of the thrust groove along an axial direction of the piston, the $L_2$ is a length of the limiting piece along the axial direction of the piston, and the S is a stroke of the piston slid in the cylinder.

11. The piston limiting structure according to claim 1, wherein, the limiting piece comprises a circular ring structure.

12. The piston limiting structure according to claim 11, wherein, the limiting piece is integrally formed with the flange.

13. The piston limiting structure according to claim 12, wherein, a diameter of the limiting piece is less than a diameter of the assembling hole, so that an avoidance space is formed on the flange.

14. The piston limiting structure according to claim 11, wherein, the limiting piece comprises a limiting ring, an end face at one end of the limiting ring abuts against the flange, and an end face at the other end abuts against the thrust surface.

15. The piston limiting structure according to claim 14, wherein, a diameter of the limiting ring is equal to a diameter of an assembling hole, a part of an outer side wall of the limiting ring circumferentially abuts against a side wall of the assembling hole of the cylinder, so that the limiting ring is limited to be radially moved.

16. The piston limiting structure according to claim 15, wherein, the limiting ring is made of a wear-resistant material.

17. The piston limiting structure according to claim 1, wherein, the flange comprises at least one of an upper flange and a lower flange.

18. A compressor, comprising:

a rotation shaft;

an upper flange of the flange;

an lower flange of the flange;

a cylinder sleeve, disposed between the upper flange and the lower flange; and the piston limiting structure according to claim 1, the cylinder is disposed in the cylinder sleeve, the rotation shaft successively passes through the upper flange, the cylinder sleeve, and the lower flange, the cylinder is driven to be rotated by the rotation shaft.

19. A heat exchange apparatus, comprising the piston limiting structure according to claim 1.

20. The heat exchange apparatus according to claim 19, wherein the heat exchange apparatus is an air conditioner.

* * * * *